US005587042A

United States Patent [19]

St. Denis

[11] Patent Number: 5,587,042

[45] Date of Patent: Dec. 24, 1996

[54] ADHESIVE CURING SYSTEM AND METHOD FOR A HEMMING MACHINE

[75] Inventor: Lucien St. Denis, Windsor, Canada

[73] Assignee: E. R. St. Denis & Sons Ltd., Oldcastle, Canada

[21] Appl. No.: 443,334

[22] Filed: May 17, 1995

Related U.S. Application Data

[63] Continuation-in-part of Ser. No. 307,470, Sep. 19, 1994, abandoned.

[51] Int. Cl.[6] ..... B32B 31/20; C09J 5/06

[52] U.S. Cl. ..... 156/477.1; 156/316; 156/321; 156/359; 156/479

[58] Field of Search ..... 156/477.1, 479, 156/480, 481, 359, 321, 216, 227

[56] References Cited

U.S. PATENT DOCUMENTS

| | | | |
|---|---|---|---|
| 3,580,770 | 5/1971 | Dyal | 156/479 |
| 3,674,605 | 7/1972 | Baumann | 156/479 |
| 4,056,421 | 11/1977 | Jarvis | 156/275.5 |
| 4,430,132 | 2/1984 | Ochi | 156/477.1 |
| 4,563,233 | 1/1986 | Henderson | 156/479 |
| 5,118,374 | 6/1992 | Suwitoadji | 156/477.1 |
| 5,150,508 | 9/1992 | St. Denis | 29/463 |

*Primary Examiner*—Daniel Stemmer

[57] ABSTRACT

A hemming machine for simultaneously bending a flange on a first panel into engagement with an edge portion of a second panel to form a hem, and at least partially curing an adhesive located in the hem. The flange bending members and/or the top surface of the panel support nest of the present invention are heated using electric cartridge heaters, hot oil, or electric heating cables, for example. During the hemming operation the nested panels are in constant direct contact with the panel support nest, and the heated flange bending members are in direct contact with the hem for approximately 3 to 6 seconds (dwell time is dependent on whether the die blocks are heated or if the die blocks are heating in conjunction with the top surface of the panel support nest), which is generally sufficient to at least partially cure the adhesive located in the hem, thereby reducing the incidence of panel shift during subsequent transfer through the manufacturing process using conveyors, racks etc. By combining the hemming and heating/curing operation of adhesive bonded hems into a single machine and operation, significant savings in machines and assembly time are realized.

14 Claims, 6 Drawing Sheets

ADHESIVE CURING SYSTEM AND METHOD FOR A HEMMING MACHINE

CROSS-REFERENCE TO RELATED APPLICATION

This application is a continuation-in-part of application Ser. No. 08/307,470, filed Sep. 19, 1994, now abandoned.

FIELD OF THE INVENTION

This invention relates to the field of hemming machines, and more particularly to hemming machines incorporating an adhesive curing system for curing adhesive bonded hems in vehicle panel assembly operations.

BACKGROUND OF THE INVENTION

It is well known to construct vehicle panels such as doors, hoods, deck lids etc. by stamping an outer panel and an inner panel which are then joined together by bending the flanged edge of the outer panel over a flat edge portion of the inner panel.

For example, Applicant's U.S. Pat. No. 5,150,508 issued Sep. 29, 1992 relates to a hemming machine for producing vehicle panels. The present invention is directed to an improvement to the hemming machine disclosed in U.S. Pat. No. 5,150,508 by integrating an adhesive curing system into the hemming machine to heat/cure adhesive bonded hems.

It has been recognized in the prior art that a standard flanged hem may not be sufficient to prevent the inner panel from sliding relative to the outer panel during the assembly process. Accordingly, it has been known to employ auxiliary attachment techniques to lock the panels against relative movement. For example, by applying an arc, mig, or fusion weld to tack the hemmed-over edge of the outer panel to the inner panel.

The use of adhesive bonded hems has also been proposed in the prior art. However, in order to heat/cure the heat activated adhesive, a separate machine and operation is required. In particular, the vehicle panels must first be hemmed in a hemming machine then moved to a curing station where the adhesive located in the hem is cured by a plurality of induction heaters located around the perimeter of the panels. The heating/curing process is required to "lock-up" the panels against shifting.

This type of operation suffers from the disadvantage of requiring distinct assembly processes and machines to hem and heat/cure the adhesive used in the hem. In addition, the heating can cause panel warp and other imperfections.

In summary, prior art heating/curing operations of adhesive bonded hems are performed independent of the hemming operation and machine, which can result in improperly joined panels and prolongs the overall assembly process.

Consequently, it would be desirable to provide an adhesive curing system and method for curing adhesive bonded hems in vehicle closure panels that can be incorporated into a hemming machine such that the hemming operation and heating/curing operation of the adhesive can be performed substantially simultaneously in a single machine.

SUMMARY OF THE INVENTION

An object of the present invention is to provide an adhesive curing system and method for curing adhesive bonded hems in vehicle closure panels, wherein the hemming operation and the heating/curing operation is performed substantially simultaneously in a single machine.

In accordance with one aspect of the invention there is provided in a machine for hemming a flange on a first panel with an edge portion of a second panel to form a hem, one of said panels having adhesive located in the hem, said machine including a plurality of flange bending members for clinching the flange on the first panel into engagement with the edge portion of the second panel to form the hem, the improvement comprising: means for heating a section of each of the plurality of flange bending members, whereby upon forming the hem the adhesive is heated and at least partially cured.

In accordance with another aspect of the present invention there is provided a flange bending member for use in a machine for bending a flange on a first panel into engagement with an edge portion of a second panel to form a hem, one of said panels having adhesive located in the hem, said flange bending member including means for heating a section of the member, whereby upon forming the hem the adhesive is heated and at least partially cured.

In accordance with another aspect of the present invention there is provided in a method for hemming a flange on a first panel with an edge portion of a second panel to form a hem, one of said panels having adhesive located in the hem, the improvement comprising: bending the flange of the first panel into engagement with the edge portion of the second panel to form the hem while substantially simultaneously heating the hem to at least partially cure the adhesive.

In accordance with another aspect of the present invention there is provided in a machine for hemming a flange on a first panel with an edge portion of a second panel to form a hem, one of said panels having adhesive located in the hem, said machine including a plurality of flange bending members for clinching the flange on the first panel into engagement with the edge portion of the second panel to form the hem and a panel support nest having a top surface for supporting the panels, the improvement comprising: first heating means for heating a section of each of the plurality of flange bending members; and second heating means for heating the top surface of the panel support nest, whereby upon forming the hem the adhesive is heated and at least partially cured.

BRIEF DESCRIPTION OF THE DRAWINGS

Embodiments of the invention will be described by way of example in conjunction with the drawings in which.

DETAILED DESCRIPTION OF EMBODIMENTS OF THE INVENTION

Figure 1:
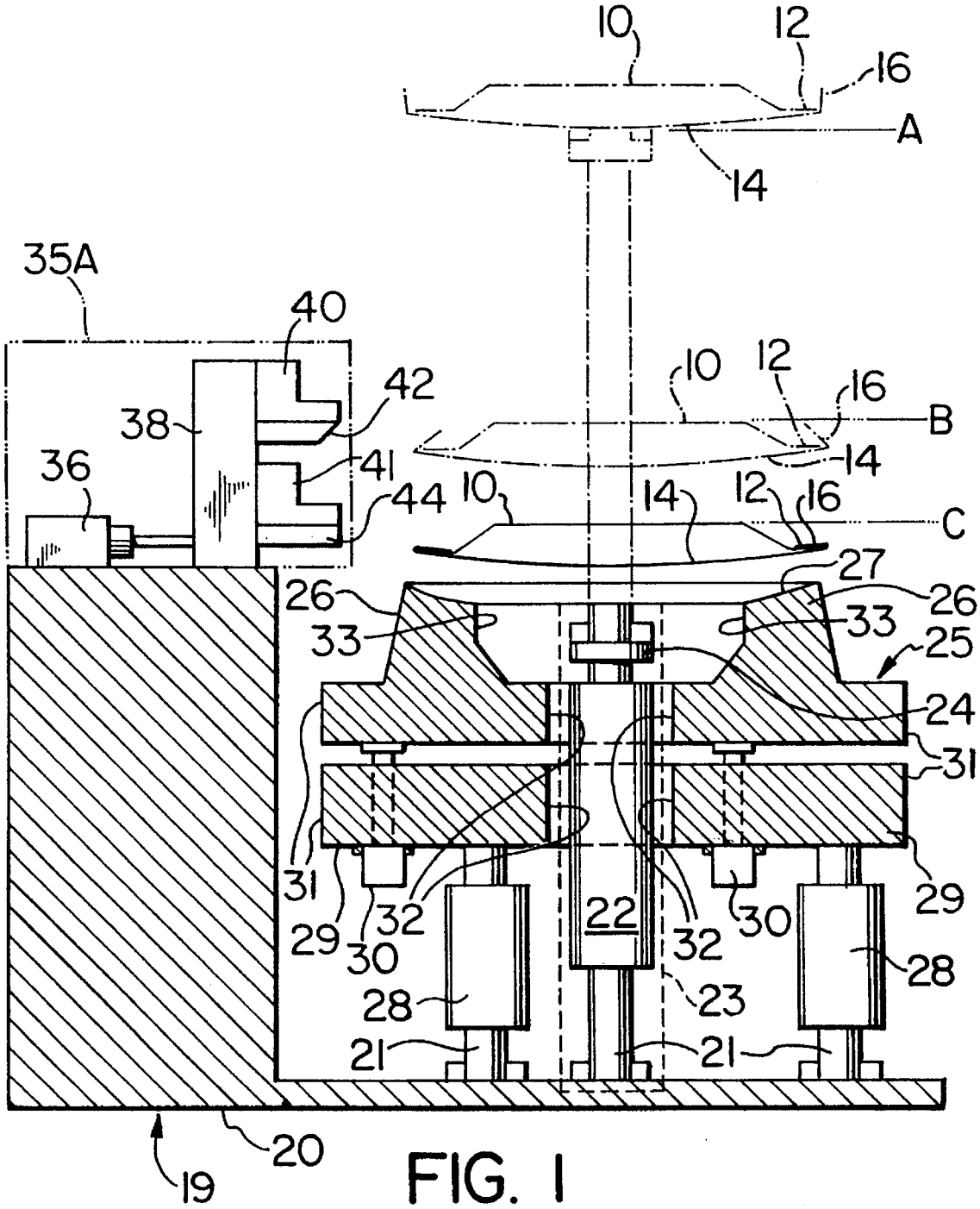
FIG. 1 PRIOR ART
FIG. 1 illustrates a schematic side sectional elevational view of a prior art hemming machine.

FIG. 1 illustrates the major components of a hemming machine 19, a complete example of which is disclosed in previously mentioned U.S. Pat. No. 5,150,508. An inner panel 10 having an edge portion 12 is nested with an outer panel 14. A securing flange 16 is located substantially around the peripheral edge of outer panel 14. The flange 16 is approximately perpendicular to the general plane of panel 14. In practice, the panels 10 and 14 are not planar, but are curved both longitudinally and transversely to conform to the shape of the side of the vehicle, hood line etc.

The hemming machine 19 consists of the following main elements: a panel lifting system 23, a panel support and press system 25, and a plurality of hemming units 35A, 35B, and 35C (only unit 35A is shown in FIG. 1).

The panel lifting system 23 comprises a transfer cradle 24 that is mounted on a transfer cylinder 22 connected to a frame 20 by a cylinder support 21. Panels 10 and 14 are placed on cradle 24 with cylinder 22 being used to raise and lower panels 10 and 14 from a transfer position A to a pre-hem position B and to a final hem position C. Lift system 23 is shown in FIG. 1 in the lowered position. The phantom lines illustrate lift system 23 in a raised position at transfer position A.

The panel support and press system 25 comprises a panel support nest 26, a support base 29 and a plurality of lift cylinders 28 and press cylinders 30. The nest 26 and base 29 have a hollow portion in the centre that permits panel lift system 23 to operate within nest 26 and base 29. The nest 26 and base 29 have an outer edge 31 and an inner edge 32.

The hemming operation occurs when the nested panels 10 and 14 are placed on panel support nest 26. The nest 26 includes top surface 27 having an inner top surface edge 33, and is shaped to conform with the contour of panel 14.

Support nest 26 is linked to base 29 by the shaft portions of press cylinders 30, which are connected to the underside of base 29. When press cylinders 30 are actuated nest 26 moves upwardly while base 29 remains in a locked position by lift cylinders 28. Cylinders 30 are used to provide the necessary force to push panels 10 and 14 against the die blocks 42 and 44 to bend flange 16 over edge 12.

The nest 26 and base 29 are raised and lowered by lift cylinders 28 connected between base 29 and frame 20 by cylinder supports 21.

The hemming units 35A–C are used to pre-hem and final hem the flange 16 of the panel 14. Die holders 40 and 41 are bolted onto a casting frame 38. A pre-hem die block 42 is bolted onto die holder 40, and has a bevelled edge that will force flange 16 to be bent by approximately 45° with respect to the general plane of panel 14. A final hem die block 44 is bolted onto die holder 41. The pre-hem and final hem die blocks 42 and 44 are generally termed flange engaging members.

The final hem die block 44 has a substantially right angled edge that is used for the final bending of flange 16 over edge portion 12. A casting cylinder 36 is used to move the frame 38 into position for the various stages of the hemming process.

Further operational details of the hemming process are discussed in the previously mentioned U.S. Pat. No. 5,150,508, which is incorporated herein by reference.

Figure 2:
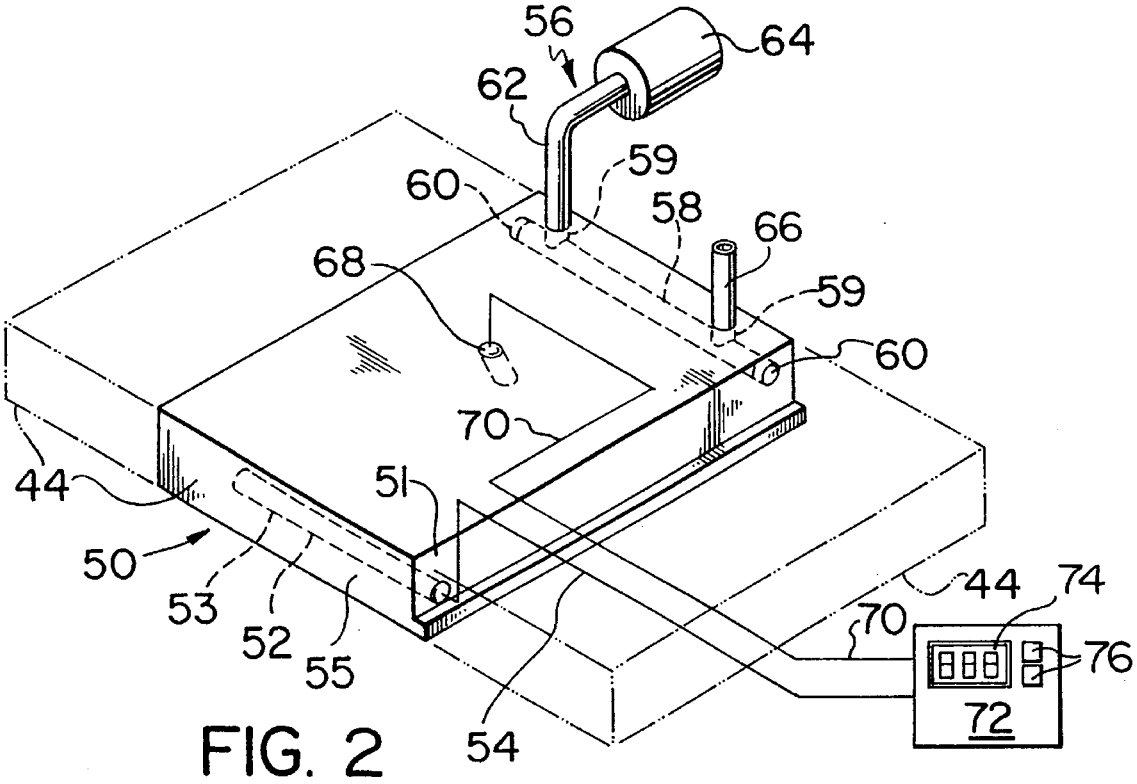
FIG. 2 illustrates a schematic perspective view of a final die block incorporating an adhesive curing system using an electric cartridge heater according to one aspect of the present invention.

Referring to FIG. 2, an adhesive curing system 50 according to an embodiment of the present invention is shown incorporated into the final hem die block 44 of the hemming machine 19. The system 50 is shown as located in one section of one die block 44 of a single hemming unit 35A, identical systems 50 are located in other sections of the die blocks 44 of the hemming units 35B and 35C.

The curing system 50 includes an elongate cylindrical electric cartridge heater 52 that is inserted into a corresponding cylindrical cavity 53 in the block 44. A wire set 54 is used to supply current to the heater 52 to heat the block 44 to a temperature of between 300° F. and 1000° F. The wire set 54 is positioned in a channel 51 located at one end of block 44, so that neighbouring sections of block 44 can be properly positioned immediately next to each other.

The heater 52 is located generally at the lower, front region of the block 44 proximate to a flange engaging region The curing system 50 includes a cooling system 56 having a longitudinally and two transversely extending cooling tunnels 58 and 59, respectively. The cooling system 56 is located in the upper, rear portion of the block 44.

The longitudinal tunnel 58 is blocked at its open ends by plugs 60. The transverse cooling tunnels 59 are in separate liquid communication with an inlet conduit 62 and an outlet conduit 66. One of the transverse cooling tunnels 59 receives cooling water from the inlet conduit 62, which is supplied by a water source 64. The water then travels along the longitudinal cooling tunnel 58; through the transverse cooling tunnel 59 connected to the outlet conduit 66 to be expelled into a drain etc. (not shown).

A temperature probe 68 having a wire set 70 is positioned in the upper, middle region of the block 44 to determine the temperature of the block 44. A control unit 72 receives the temperature information from the probe 68 via the wire set 70, and adjusts the temperature of the heater 52 by changing the current flow through wire set 54 accordingly, based on an established preset temperature programmed into the control unit 72.

The temperature information from the probe 68 is shown on temperature display 74 located on the control unit 72° Temperature adjusting controls 76 are located on the control unit 72 to modify the desired temperature of the heated section of block 44.

Figure 3:
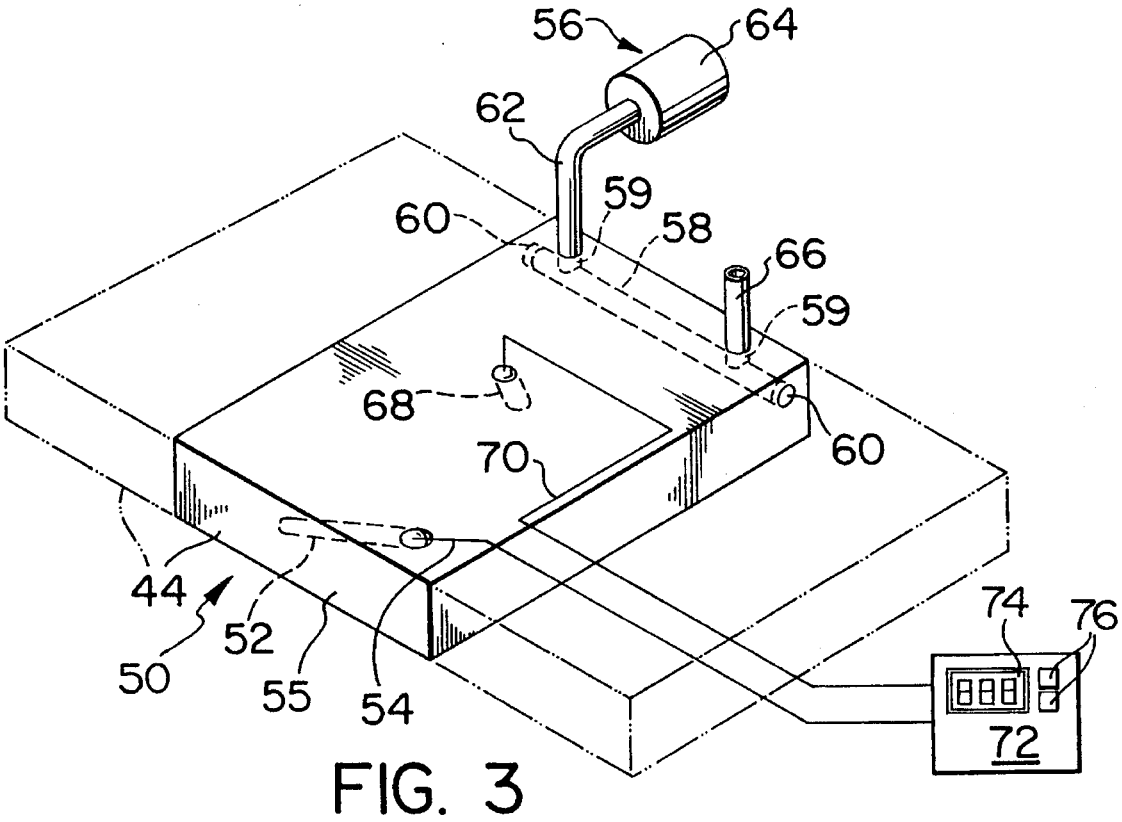
FIG. 3 illustrates a schematic perspective view of a final die block incorporating an adhesive curing system using a cartridge heater according to another aspect of the present invention.

FIG. 3 illustrates another arrangement in which the heater 52 is located diagonally within the front region of the block 44. The cooling system 56 and probe 68 operation and location are equivalent to the embodiment discussed in conjunction with FIG. 2.

Figure 4:
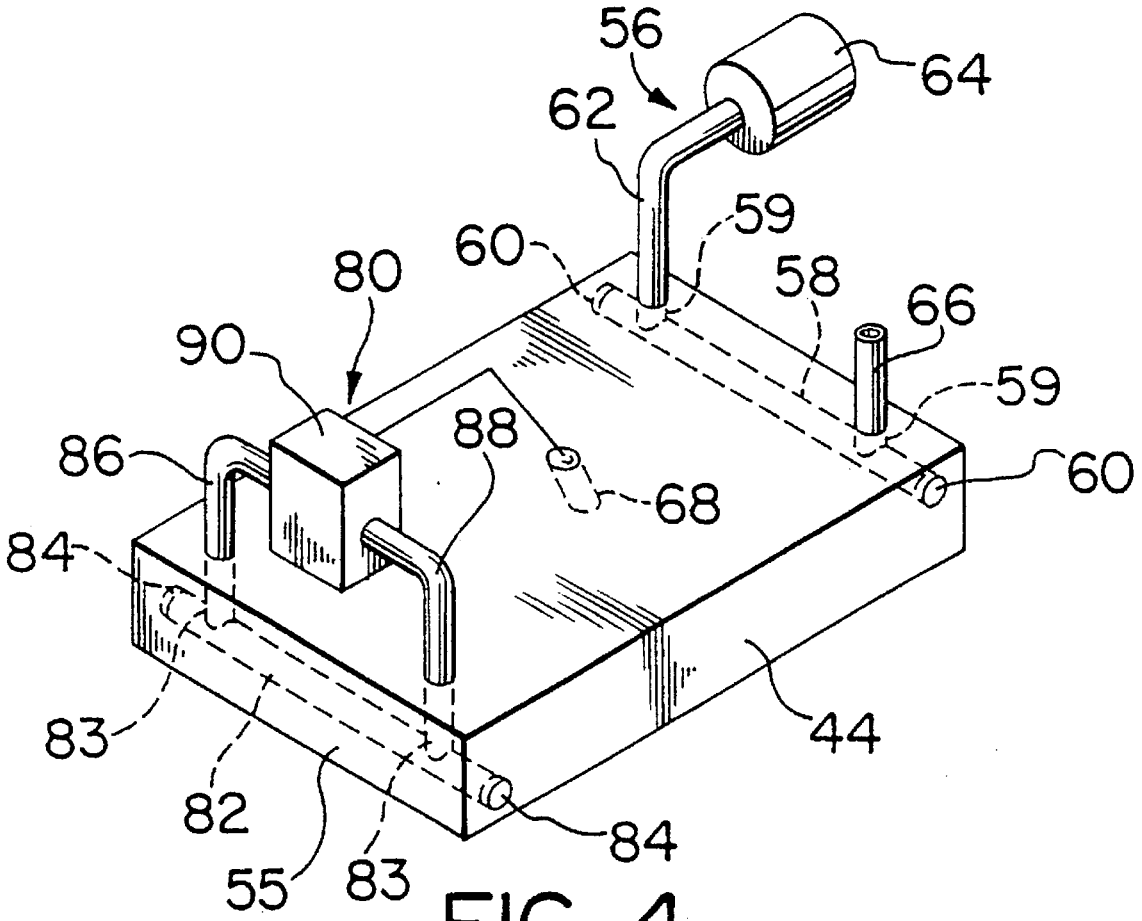
FIG. 4 illustrates a schematic perspective view of a final die block incorporating an adhesive curing system using hot circulating oil according to another aspect of the present invention.

Referring to FIG. 4, an adhesive curing system 80 according to another embodiment of the present invention is shown incorporated into the final hem die block 44 of the hemming machine 19. The system 80 is shown as located in one section of one die block 44 of a single hemming unit 35A, identical systems 80 are located in other sections of the die blocks 44 of the hemming units 35B and 35C.

The curing system 80 includes a longitudinally and two transversely extending oil tunnels 82 and 83, respectively. The longitudinal oil tunnel 82 of the curing system 80 is located in the lower, front region of the block 44. The longitudinal tunnel 82 is blocked at its open ends by plugs 84. The transverse oil tunnels 83 are in separate liquid communication with an inlet conduit 86 and an outlet conduit 88.

A hot oil heater/pump 90 is connected between inlet conduit 86 and the outlet conduit 88. The heater/pump 90 circulates heated oil through to the longitudinal tunnel 82 to heat the block 44 proximate the flange engaging region 55.

In particular, one of the transverse oil tunnels 83 receives hot oil from the inlet conduit 86 supplied by the hot oil heater/pump 90. The oil then travels along the longitudinal oil tunnel 82 through the transverse oil tunnel 83 connected to the outlet conduit 88 to be recirculated by heater/pump 90. The wire set 70 of the temperature probe 68 is connected directly to the heater/pump 90 so that the heater/pump 90 can modify the level of heating of the oil based on a preprogrammed temperature defined in the heater/pump 90.

The hot oil heating system 90 includes the same cooling system 56 as discussed in conjunction with FIG. 2.

Figure 5:
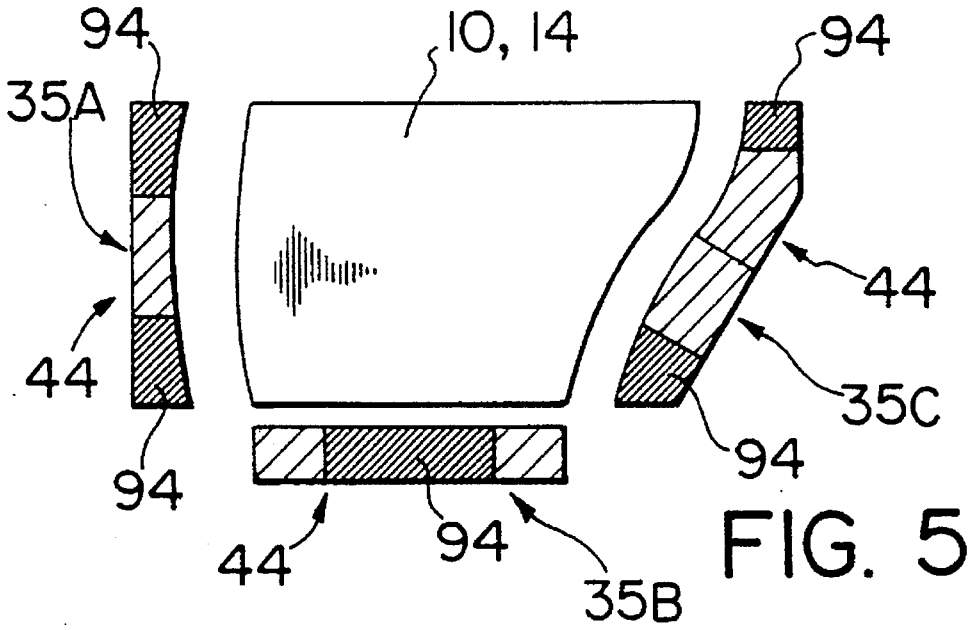
FIG. 5 illustrates a top plan view of nested panels positioned within an arrangement of die blocks 44.

FIG. 5 illustrates a top plan schematic of a door panel assembly (10, 14) positioned within the final hem blocks 44 of the hemming unit 35A, 35B, and 35C. A plurality of hot-sections 94 designate the sections of the die block 44 that incorporate the curing system 50, or 80 of the present invention as discussed in conjunction with FIGS. 2 to 4. The hot-section arrangement of FIG. 5 is merely one example of possible arrangements. It is also possible to have only one hot-section 94 per side of the panel assembly (10,14) to be hemmed, depending on adhesive characteristics, panel material etc.

Figure 6A:
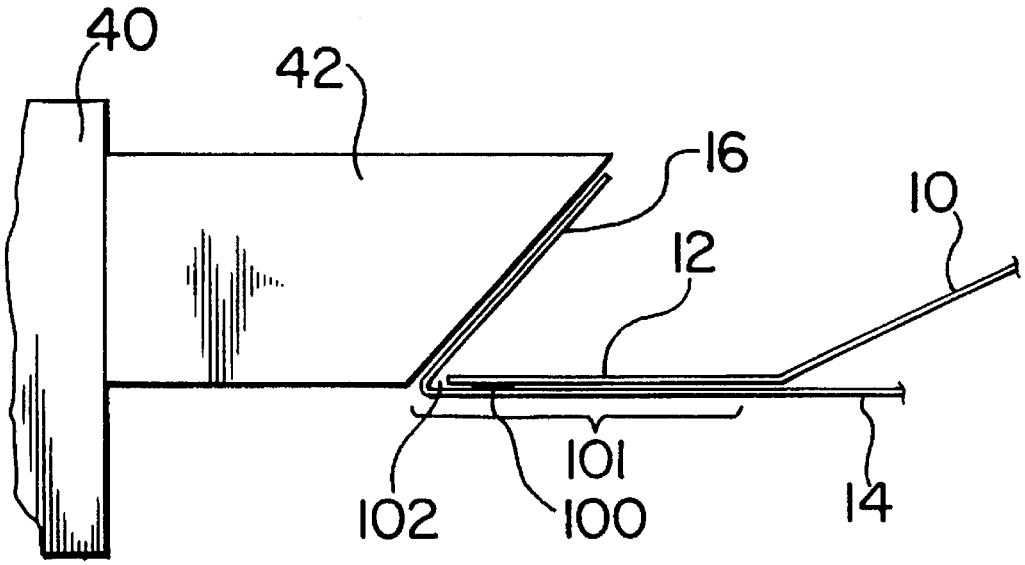
FIG. 6A PRIOR ART
FIG. 6A illustrates a side-sectional view of the pre-hem stage of a prior art pre-hem operation.
Figure 6B:
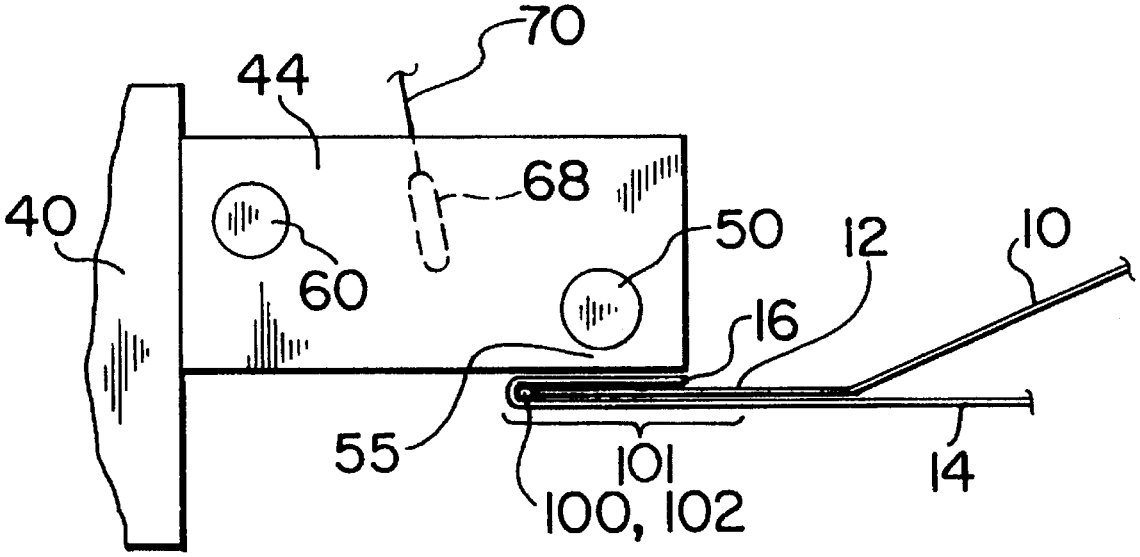
FIG. 6B illustrates a side-sectional view of the final-hem and heating/curing stage according to a method of the present invention.

A method of heating/curing an adhesive during a hemming operation according to one embodiment of the present invention will be discussed in conjunction with FIG. 6A and FIG. 6B. Prior to placing the nested panels 10 and 14 in the hemming machine 19, a bead of heat activated adhesive 100 (e.g. a 3M (Trademark) 2-part epoxy resin) of approximately ⅛ of an inch in diameter is placed around the perimeter of the inner surface of the outer panel 14 in a hem region 101. The following steps are performed in the hemming machine 19 to substantially simultaneously hem the flange 16 and heat the adhesive 100 in the hem to at least partially cure the adhesive:

(a) Heat sections 94 of the final hem die blocks 44 of the hemming units 35A–C by using a temperature source such as electric cartridge heaters, or circulating hot oil to a temperature of approximately 550° F., for example; as discussed in conjunction with FIGS. 2 to 5;

(b) Pre-hem the flange 16 to 45° at position B, as shown in FIG. 6A;

(c) Move pre-hemmed panels 10 and 14 to the final hem position C; and (d) Final hem the flange 16 of the outer panel 14 into firm engagement with edge portion 12 of the inner panel 10 to form the hem, as shown in FIG. 6B. During this step, the heated sections 94 of the blocks 44 are held in firm engagement against sections of the hem region 101 of the panels 10 and 14 for approximately 5 to 6 seconds. During this time the heat from the blocks 44 transfer through the panels 10 and 14 to heat the adhesive 100 causing it to at least partially cure the adhesive 100. In addition, during the final hem process, the adhesive 100 is generally forced to occupy a gap 102 between the edge portion 12 of the inner panel 10 and the outer panel 14 to provide a lock-up between the inner panel 10 and the outer panel 14.

The actual curing time of the adhesive 100 is at least partly dependent on the adhesive used, the temperature of the blocks 44, and panel material (i.e. aluminum or steel). Consequently, the final hem dwell time of step (d) can be varied accordingly.

By at least partially curing the adhesive 100 in the hem region 101 between the nested panels 10 and 14, the incidence of the panel shift is reduced during subsequent transfer through the manufacturing process using conveyors, racks etc. In addition, where adhesive 100 is forced to occupy the gap 102 further resistance to panel shift is provided.

Since the initial curing operation occurs during the actual final hem operation, the panels 10 and 14 do not have to be moved to a separate curing station that generally results in panel shift, and a slow down in the overall assembly process. The adhesive 100 will eventually be fully cured during the paint bake process that occurs in another station on the assembly line.

An alternative embodiment of the present invention involves heating the top surface 27 of the panel support nest 26 of the hemming machine 19 in conjunction with heating the final hem die blocks 44 as discussed in conjunction with FIGS. 2 to 6B.

Figure 7:
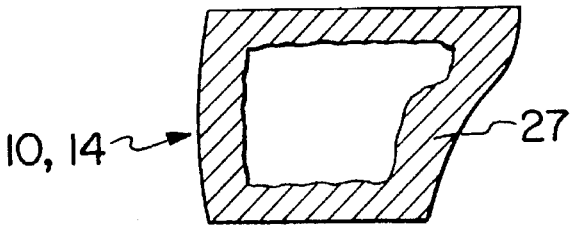
FIG. 7 illustrates a top plan view of nested panels positioned on the panel support nest of the hemming machine.

FIG. 7 shows the nested panels 10 and 14 positioned on the top surface 27 of the panel support nest 26, which is heated as described hereinbelow in conjunction with FIGS. 8 to 11.

Figure 8:
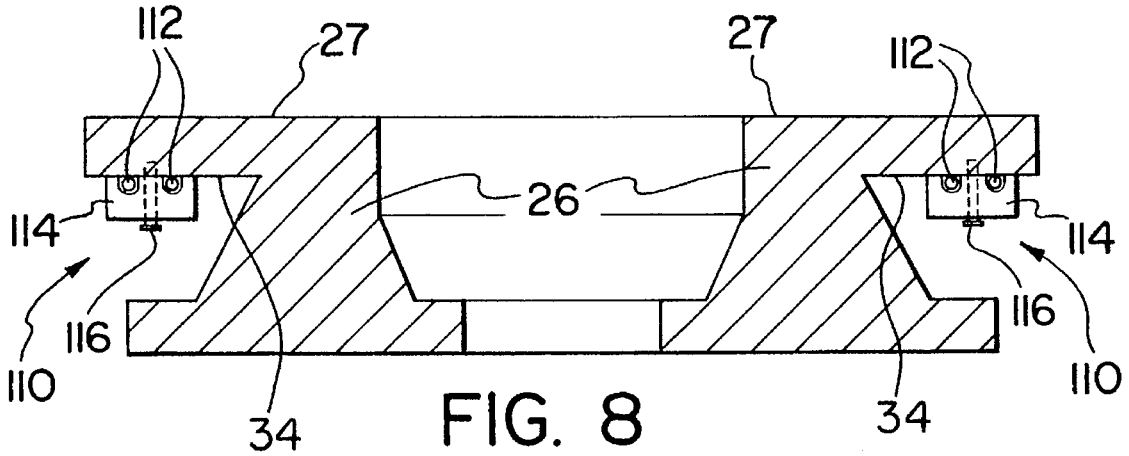
FIG. 8 illustrates a schematic section of a portion of the panel support nest of a hemming machine incorporating a heating system according to another aspect of the present invention.

Referring to FIG. 8, a heating system 110 is shown attached to the panel support nest 26 of the hemming machine 19. The heating system 110 is attached around the entire perimeter of the nest 26 to provide a uniformly heated top surface 27. The representation of the nest 26 and top surface 27 has been simplified in FIG. 8 for illustration purposes. The top surface 27 is normally curved to support a correspondingly curved panel 10 as shown in FIG. 1.

Figure 9:
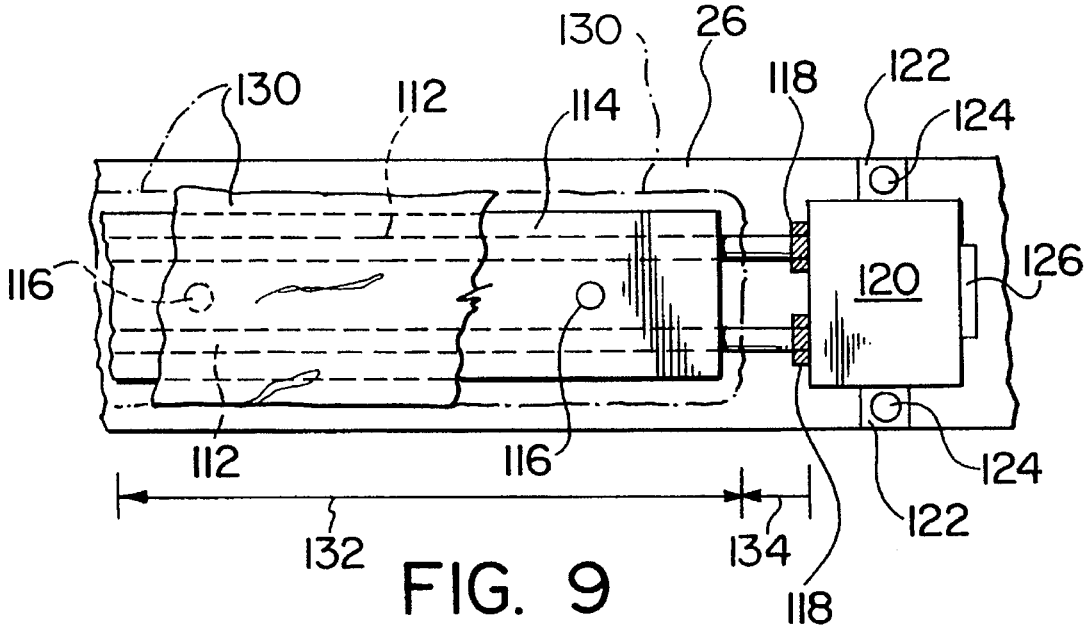
FIG. 9 illustrates a plan view of a straight section of the support nest incorporating the support nest heating system of the present invention.
Figure 10:
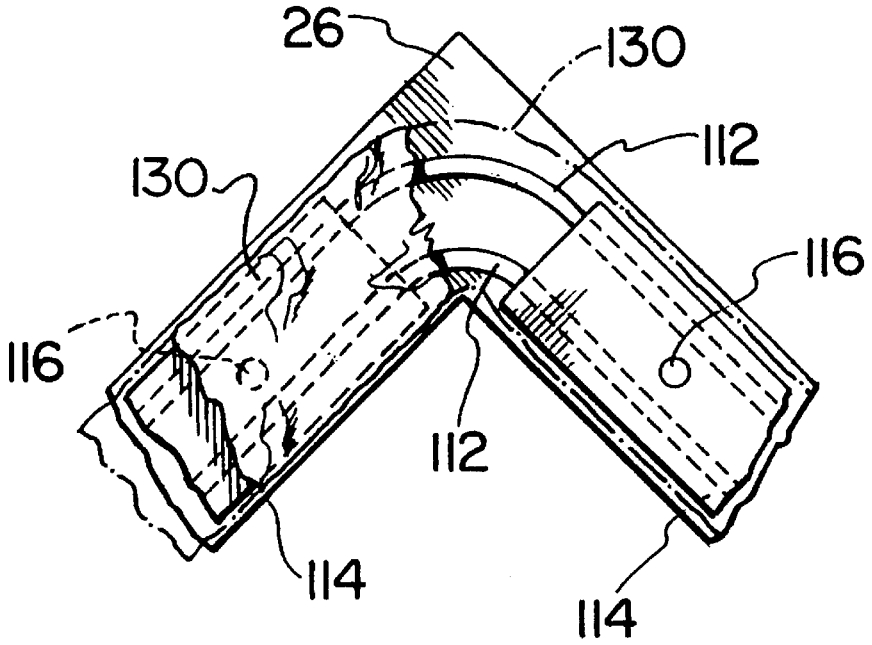
FIG. 10 illustrates a plan view of a corner section of the support nest incorporating the support nest heating system of the present invention.

Referring to FIGS. 9 and 10, the heating system 110 includes a electric heating cables 112, held against an underside surface 34 of the panel support nest 26. Two individual cables 112 are illustrated in the drawings to provide a uniformly heated top surface 27; however, depending on the individual hemming requirements only one cable 112 or more than two cables 112 can be used.

The cables 112 are held in a spaced relation to the underside surface 34 by a plurality of retainer blocks 114 having recesses 115 (see FIG. 8). Each recess 115 is shaped to receive one of the cables 112. Bolts 116 are used to secure the blocks 114 to the support nest 26. In regions where retainer blocks 114 cannot easily be used (i.e. at corners, see FIG. 10); exposed cables 112 are merely laid out around the curving section etc. to ensure the individual cables 112 do not touch each other.

Each cable 112 includes a coupler 118 that connects to a control unit 120 for controlling the temperature of the cables 112. The control unit 120 is attached to the support nest 26 with mounting brackets 122 and mounting blots 124.

The control unit 120 and the cables 112 are powered by a voltage source (not shown) attached to the control unit 120 through a power connector 126. Current is supplied to the cables 112 to heat the top surface 27 of the nest 26 to a temperature of between 100° F. and 300° F., where the preferred temperature is approximately 150° F.

The cables 112 are connected to the underside surface 34 of the nest 26 to heat a region of the top surface 27 where the nested panels 10, 14 are positioned during the hemming operation so that the heated top surface 27 is in contact with the hem region 101 of the nested panels 10, 14, represented by the shaded region of FIG. 7.

The cables 112, such as Pyrotenax (Trademark) mineral insulated heating cable design "D", are divided into a heated lead length 132 and a cold lead length 134. The heated lead length 132 of all of the cables 112 are covered with a foil shield 130 (e.g. aluminum foil) to ensure that heat deflects upwards towards the top surface 27. The foil 130 covers all heated lead length 132 portions of the cable 112 (i.e. cable portions positioned under retainer blocks 114; and exposed cable 112 portions located at corners and the like, as shown in FIG. 10).

Figure 11:
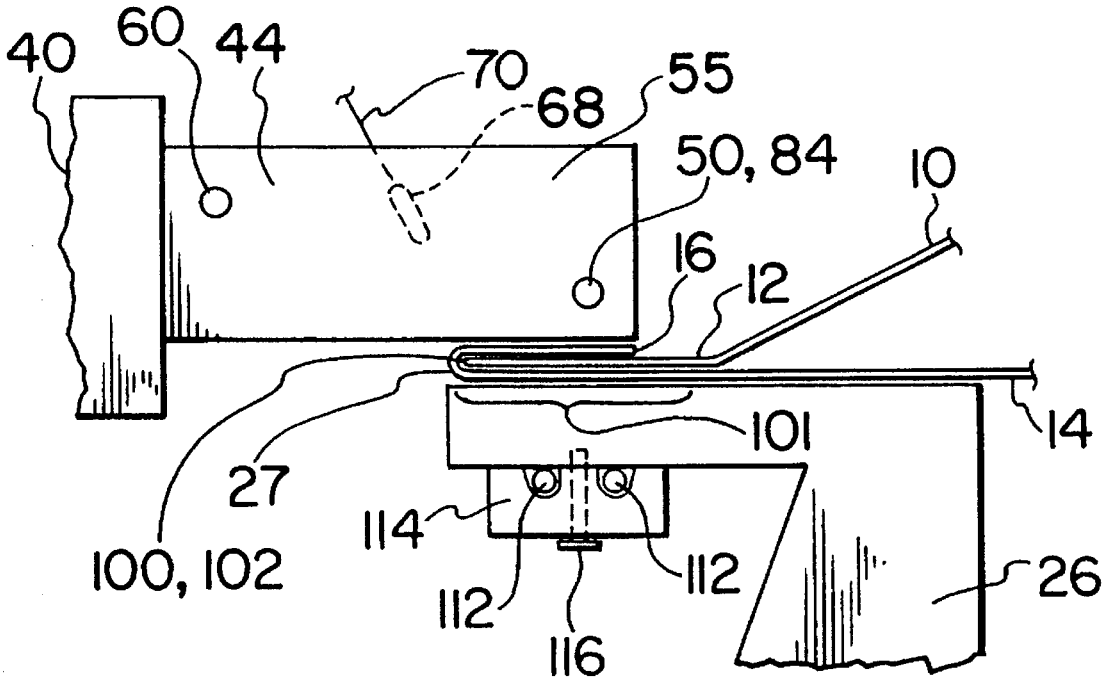
FIG. 11 illustrates a side-sectional view of the final-hem and heating/curing stage according to another method of the present invention.

A method of heating/curing an adhesive during a hemming operation according to another embodiment of the present invention will be discussed in conjunction with FIG. 11. Prior to placing the nested panels 10 and 14 in the hemming machine 19, a bead of heat activated adhesive 100 (e.g. a 3M (Trademark) 2-part epoxy resin) of approximately ⅛ of an inch in diameter is placed around the perimeter of the inner surface of the outer panel 14 in the hem region 101. The following steps are performed in the hemming machine 19 to substantially simultaneously hem the flange 16 and heat the adhesive 100 in the hem to at least partially cure the adhesive:

(a) Heat the top surface 27 of the panel support nest 26 by using a temperature source such as electric heating cables 112 (e.g. Pyrotenax (Trademark) heating cable design "D") to approximately 150° F., for example; as discussed in conjunction with FIGS. 7 to 10;

(b) Heat sections 94 of the final hem die blocks 44 of the hemming units 35A–C by using a temperature source such as electric cartridge heaters, or circulating hot oil, to approximately 450° F., for example; as discussed in conjunction with FIGS. 2 to 5;

(c) Pre-hem the flange 16 to 45° at position B, as shown in FIG. 6A;

(d) Move pre-hemmed panels 10 and 14 to the final hem position C; and (e) Final hem the flange 16 of the outer panel 14 into firm engagement with edge portion 12 of the inner panel 10 to form the hem, as shown in FIG. 11. During this step, the heated sections 94 of the blocks 44 are held in firm engagement against sections of the hem region 101 of the panels 10 and 14 for approximately 3 to 5 seconds. During this time the heat from the blocks 44 and the panel support nest 26 transfer through the panels 10 and 14 to heat the adhesive 100 causing it to at least partially cure the adhesive 100. In addition, during the final hem process, the adhesive 100 is generally forced to occupy the gap 102 between the edge portion 12 of the inner panel 10 and the outer panel 14 to provide a lock-up between the inner panel 10 and the outer panel 14.

The dwell time (3 to 5 seconds) is shortened using the method illustrated in FIG. 11, relative to the dwell time (5 to 6 seconds) of FIG. 6B due to the additional heat provided by the top surface 27 of the panel support nest 26.

In particular, as the panels 10, 14 move through the pre-hem stage (step (c), above) the hem region 101 of the panels 10, 14 is heated to approximately 65° F. (assuming a top surface temperature of 150° F.) and increases to approximately 110° F. as the panels 10, 14 move to the final hem position (step (e), above). This ensures that the adhesive 100 is warmed prior to the final hem operation when high heat (for example, 450° F.) is applied by the final hem die blocks 44 to at least partially cure the adhesive 100 to provide the require lock-up, as discussed above.

The present embodiment offers the same advantages as discussed in conjunction with FIG. 6B in relation to the curing of the adhesive 100 to reduce the incidence of panel shift and the like. Further, since the initial curing operation occurs during both the pre-hem and final hem operations (in reference to the embodiment of FIGS. 7 to 11), the temperature of the blocks 44 can be reduced, relative to heating only the block 44, thereby reducing oil burn off, panel warp, and machine expansion that can occur when operating at high temperatures (e.g. above 550° F.).

Although the adhesive curing systems and methods are discussed for use with the hemming machine disclosed in U.S. Pat. No. 5,150,508, it can be readily adapted to many different types of hemming machines.

I claim:

1. A machine for hemming a flange on a first rigid panel with an edge portion of a second rigid panel to form a hem, one of said panels having adhesive located in the hem, said machine comprising:

(a) a panel support nest having a top surface for supporting the first panel and the second panel in a superimposed relation with the edge portion of the second panel proximate to the flange of the first panel;

(b) a support surface heater for heating a portion of the support surface of the support nest;

(c) a plurality of first flange bending members having bevelled engaging surfaces, the first flange bending members being located at a pre-hem position;

(d) a plurality of second flange bending members located at a final hem position;

(e) a second flange bending member heater for heating a section of each of the plurality of second flange bending members;

(f) means for moving the support nest to the pre-hem position such that the flange of the first panel is pressed against the bevelled engaging surfaces of the first flange bending members wherein the flange of the first panel is bent to approximately 45° with respect to the plane of the first panel to form a pre-hemmed flange; and (g) means for moving the support nest to the final hem position such that the pre-hemmed flange is pressed against the second flange bending members, wherein said pre-hemmed flange of the first panel is bent to fully clinch said edge portion of the second panel to form the hem and whereby upon forming the hem the adhesive is heated and at least partially cured.

2. The machine of claim 1, further including means for cooling a region of the heated section of each of the plurality of second flange bending members.

3. The machine of claim 2, wherein the means for cooling includes means for circulating cooling water into the region.

4. The machine of claim 1, wherein the second flange bending member heater includes an electrical element inserted into a cavity formed in the heated section of each of the second flange bending members.

5. The machine of claim 1, wherein the second flange bending member heater includes means for circulating hot oil into the heated section of each of the second flange bending members.

6. The machine of claim 1, further including means for generating a first temperature signal representative of the temperature of the heated section of each of the plurality of second flange bending members and a second temperature signal representative of the temperature of the top surface of the panel support nest.

7. The machine of claim 6, further including control means responsive to the temperature signals for adjusting the heat generated by the support surface heater and the second flange bending member heater.

8. The machine of claim 1, wherein the support surface heater includes a first heating cable connected to the panel support nest to substantially uniformly heat the top surface.

9. The machine of claim 8, further including a second heating cable connected to the panel support nest proximate and in spaced relation to the first heating cable, wherein the heating cables are positioned in a location opposing the top surface such that a concentration of heat is provided to the top surface in a region proximate the position of the hem of the panels when the panels are in a hemming position on the panel support nest.

10. The machine of claim 9, further including reflection means attached to the heating cables for deflecting heat in a direction towards the top surface of the panel support nest.

11. The machine of claim 10, wherein the reflection means is aluminum foil.

12. The machine of claim 10, wherein the top surface of the panel support nest is substantially uniformly heated to a temperature of between 100° F. and 300° F.

13. The machine of claim 1, wherein a ratio of the temperature of the heated section of each of the plurality of second flange bending members and the heated portion of the top surface of the panel support nest is approximately 3 to 1.

14. The machine of claim 13, wherein the temperature of the heated section of each of the plurality of second flange bending members is approximately 450° F. and the temperature of the heated portion of the top surface of the panel support nest is approximately 150° F.

* * * * *